US009255710B2

(12) United States Patent
Cadima

(10) Patent No.: US 9,255,710 B2
(45) Date of Patent: Feb. 9, 2016

(54) MULTI-RING GAS BURNER

(71) Applicant: General Electric Company, Schenectady, NY (US)

(72) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 359 days.

(21) Appl. No.: 13/773,986

(22) Filed: Feb. 22, 2013

(65) Prior Publication Data

US 2014/0238384 A1 Aug. 28, 2014

(51) Int. Cl.
*F23D 14/26* (2006.01)
*F23D 14/06* (2006.01)

(52) U.S. Cl.
CPC ..... *F23D 14/06* (2013.01); *F23D 2900/14062* (2013.01)

(58) Field of Classification Search
CPC ..... F23D 2900/14062; F23D 2207/00; F24C 3/106
USPC ..... 126/39 R, 39 E; 431/278, 286
See application file for complete search history.

(56) References Cited

U.S. PATENT DOCUMENTS

| | | | | |
|---|---|---|---|---|
| 1,437,201 | A | 11/1922 | Schumann | |
| 2,498,289 | A * | 2/1950 | Moecker, Jr. et al. | 431/194 |
| 5,401,164 | A * | 3/1995 | Yen | 431/354 |
| 6,132,205 | A * | 10/2000 | Harneit | 431/354 |
| 8,245,703 | B2 * | 8/2012 | Cadeau et al. | 126/39 E |
| 8,464,703 | B2 * | 6/2013 | Ryu et al. | 126/39 E |
| 2007/0218414 | A1 * | 9/2007 | Harneit | 431/354 |
| 2010/0051013 | A1 * | 3/2010 | Cadeau et al. | 126/39 E |
| 2014/0190467 | A1 * | 7/2014 | Cadima | 126/39 E |

FOREIGN PATENT DOCUMENTS

JP 07190316 A * 7/1995 ..... F23D 14/06

OTHER PUBLICATIONS

Ikeda, Mitsuo; JP 07190316 A; Jul. 1995; English machine translation.*

* cited by examiner

*Primary Examiner* — Jorge Pereiro
(74) *Attorney, Agent, or Firm* — Dority & Manning, P.A.

(57) ABSTRACT

A multi-ring gas burner for a cooktop appliance is provided. The multi-ring gas burner includes an inner burner ring, an outer burner ring, and a carryover slot that extends between about the inner burner ring and about the outer burner ring. A pair of restrictors defines a Venturi throttle therebetween. The Venturi throttle can assist with regulating a flow of gaseous fuel out of the carryover slot.

16 Claims, 6 Drawing Sheets

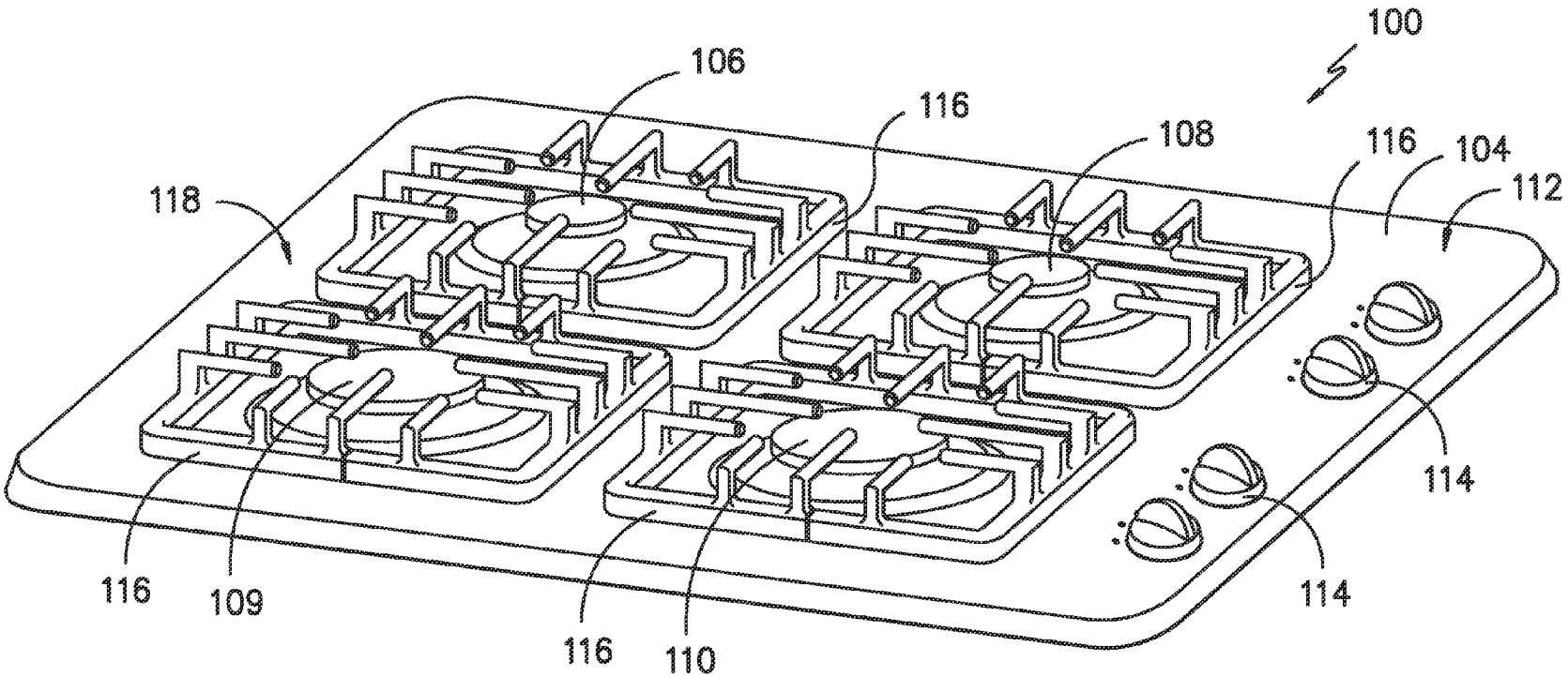
FIG. —1—

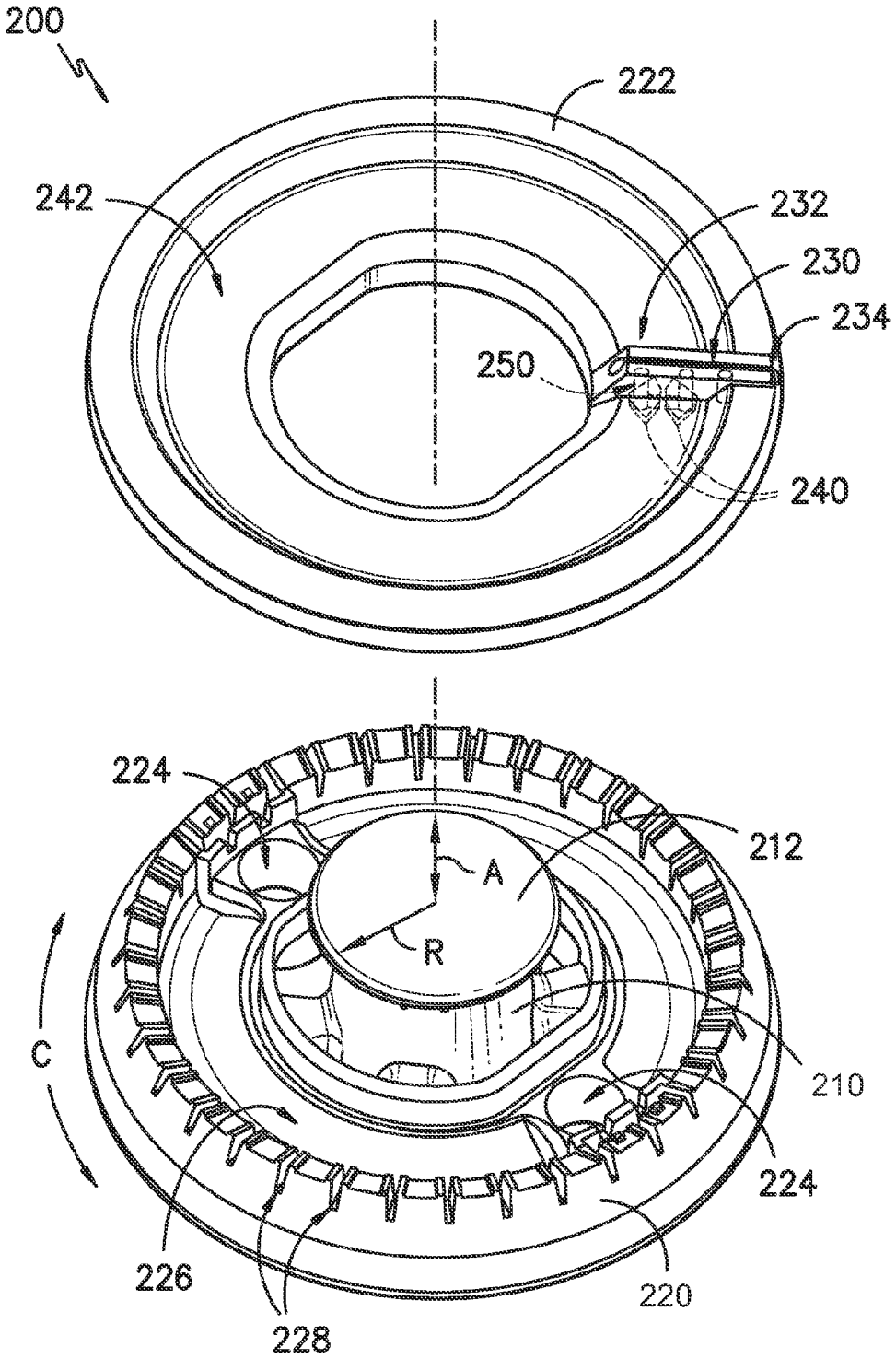
FIG. —2—

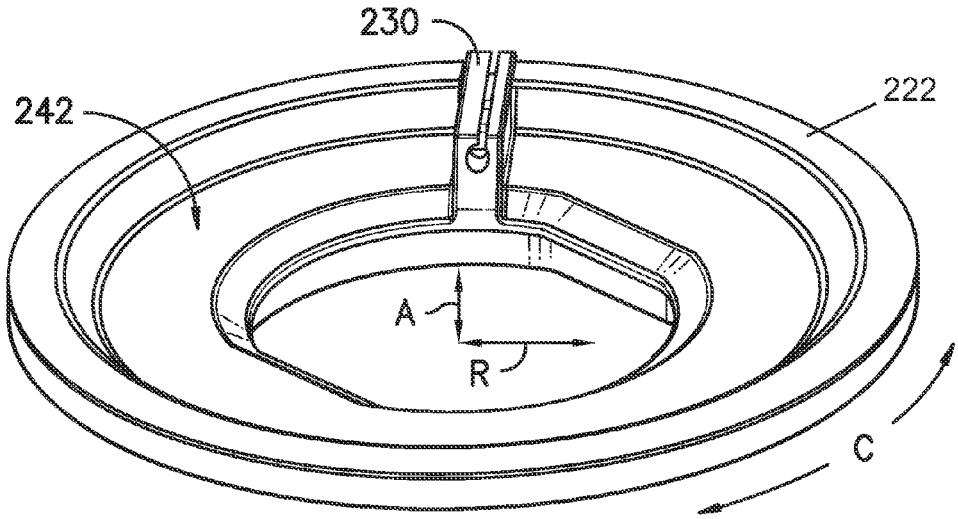
FIG. —3—
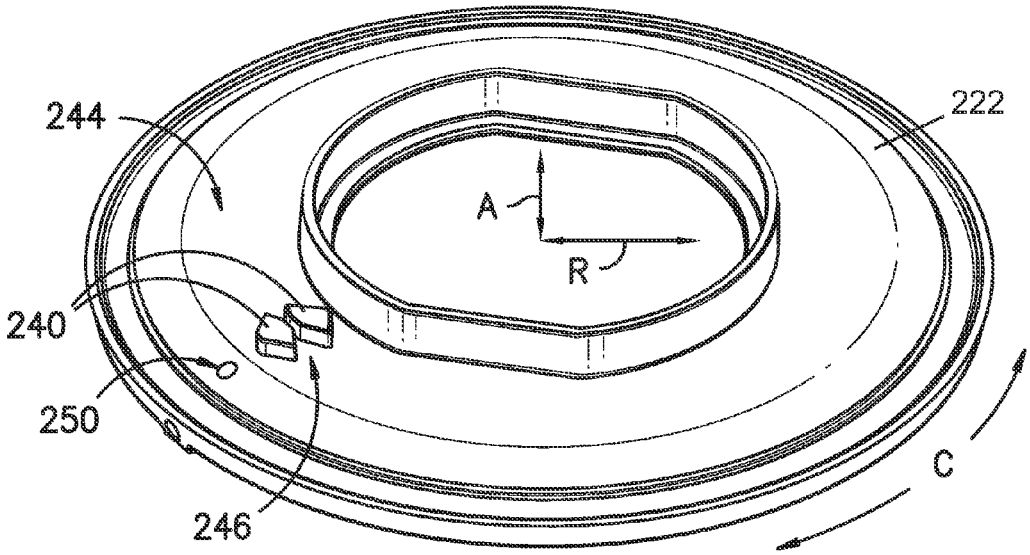
FIG. —4—

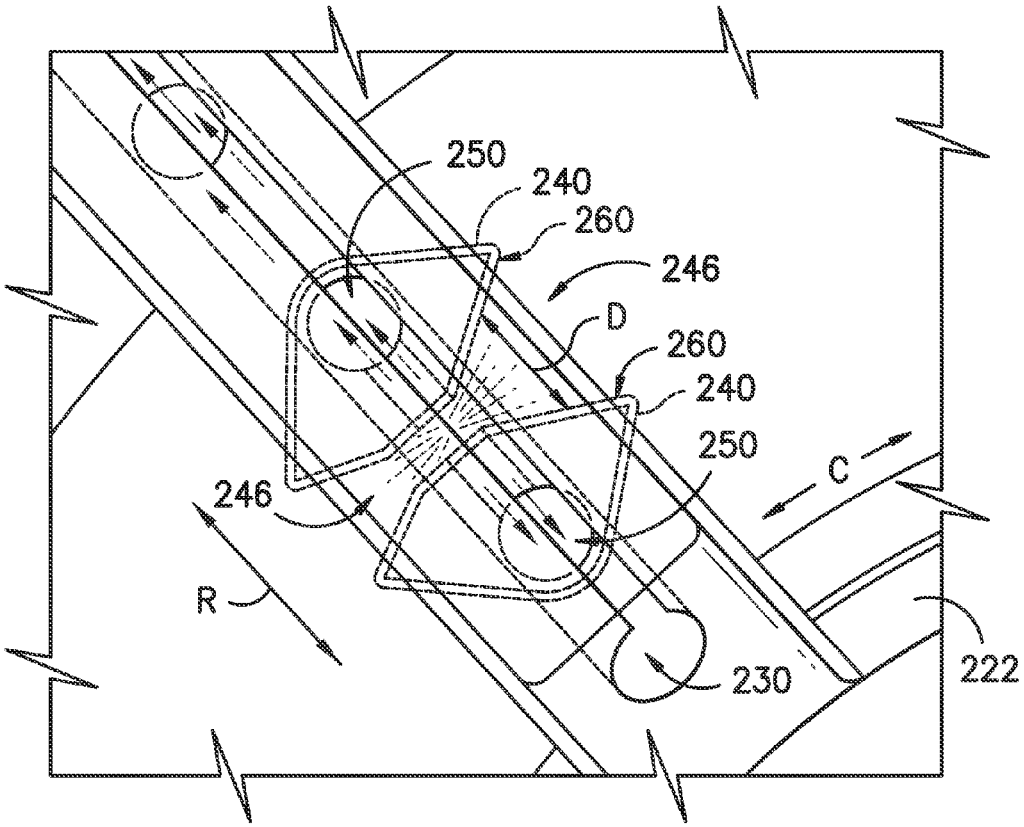
FIG. —6—

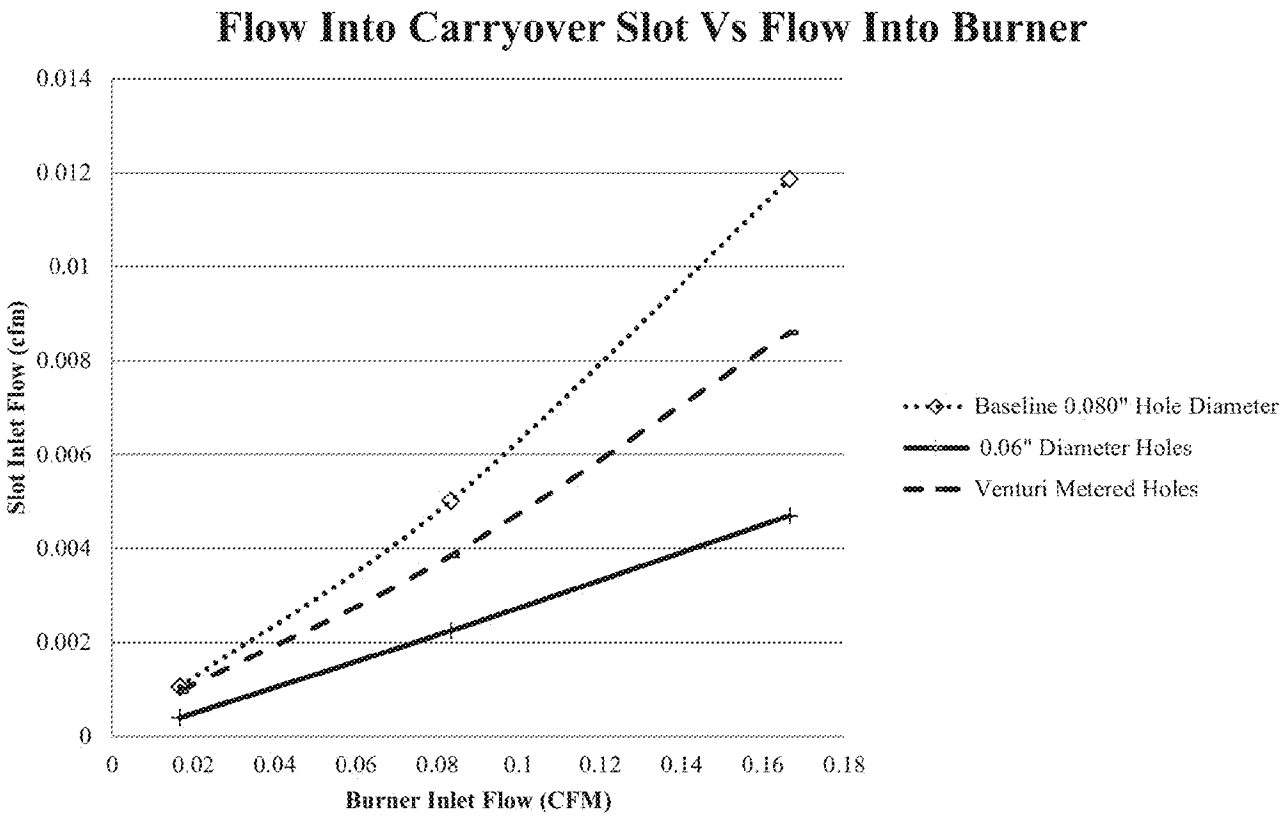
FIG. —7—

MULTI-RING GAS BURNER

FIELD OF THE INVENTION

The present subject matter relates generally to cooktop appliances and gas burners for the same.

BACKGROUND OF THE INVENTION

Certain cooktop appliances include multi-ring gas burners. Such burners can include a center burner surrounded by one or more concentric burner rings. Certain multi-ring gas burners ignite gaseous fuel, such as propane of natural gas, at one of the burner rings and utilize carryover slots to carry flames and ignite gaseous fuel at other burner rings.

Generally, carryover slots suffer from certain problems. In particular, flames at the carryover slot can be unsightly, e.g., due to their height, when the gas burner is operating at a high flow rate. One solution to this problem is to reduce the carryover slot's inlet size in order to restrict the flow of fuel out of the carryover slot at high flow rates. However, this solution has its own drawbacks. In such carryover slots, fuel flow through the carryover slot can insufficient for proper operation when the gas burner is operating at a low flow rate.

Accordingly, a multi-ring gas burner having a carryover slot with features for properly regulating fuel flow at both high and low flow rates would be useful. In particular, a multi-ring gas burner having a carryover slot with features for limiting flame height at high flow rates and for providing sufficient fuel at low flow rates would be useful.

BRIEF DESCRIPTION OF THE INVENTION

The present subject matter provides a multi-ring gas burner for a cooktop appliance. The multi-ring gas burner includes an inner burner ring and an outer burner ring. A carryover slot extends between about the inner burner ring and about the outer burner ring. A pair of restrictors defines a Venturi throttle therebetween. The Venturi throttle can assist with regulating a flow of gaseous fuel out of the carryover slot. Additional aspects and advantages of the invention will be set forth in part in the following description, or may be apparent from the description, or may be learned through practice of the invention.

In a first exemplary embodiment, a multi-ring gas burner for a cooktop appliance is provided. The multi-ring gas burner defines a radial direction. The multi-ring gas burner includes an inner burner ring that defines a plurality of outlets for directing gaseous fuel out of the inner burner ring. The multi-ring gas burner also includes an outer burner ring spaced apart from the inner burner ring along the radial direction. The outer burner ring defines a plurality of outlets for directing gaseous fuel out of the outer burner ring. The outer burner ring has a cover that defines a carryover slot and a plurality of passages for supplying gaseous fuel to the carryover slot. The carryover slot of the cover extends along the radial direction between about the outlets of the inner burner ring and about the outlets of the outer burner ring. Each passage of the plurality of passages has an inlet for receiving gaseous fuel. A pair of restrictors is mounted to the cover of the outer burner ring. Each restrictor of the pair of restrictors is positioned at a respective one of the inlets of the plurality of passages. The pair of restrictors defines a Venturi throttle therebetween.

In a second exemplary embodiment, a multi-ring gas burner for a cooktop appliance is provided. The multi-ring gas burner defines a radial direction. The multi-ring gas burner includes an inner burner ring and an outer burner ring spaced apart from the inner burner ring along the radial direction. A carryover slot extends along the radial direction between the inner and outer burner rings. The carryover slot includes a plurality of passages dispersed along the radial direction between the inner and outer burner rings. Each passage of the plurality of passages has an inlet for receiving gaseous fuel. A pair of restrictors defines a Venturi throttle therebetween. Each restrictor of the pair of restrictors is positioned at a respective one of the inlets of the plurality of passages.

In a third exemplary embodiment, a multi-ring gas burner for a cooktop appliance is provided. The multi-ring gas burner defines a radial direction. The multi-ring gas burner includes an inner burner ring and an outer burner ring spaced apart from the inner burner ring along the radial direction. A carryover slot extends along the radial direction between about the inner burner ring and about the outer burner ring. The multi-ring gas burner also includes means for regulating a flow of gaseous fuel out of the carryover slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of an exemplary embodiment of a cooktop appliance as may be used with the present subject matter.

FIG. 2 provides a perspective view of a multi-ring gas burner according to an exemplary embodiment of the present subject matter with a cover of the gas burner removed to reveal a fuel chamber of the gas burner.

FIG. 3 provides a top perspective view of the cover of the gas burner of FIG. 2.

FIG. 4 provides a bottom perspective view of the cover of the gas burner of FIG. 2.

FIG. 6 provides a partial elevation view of the cover of the gas burner of FIG. 2.

FIG. 7 provides a plot of flow rates into gas burner versus flow rates into a carryover slot of the gas burner for various passage configurations.

DETAILED DESCRIPTION

Figure 5:
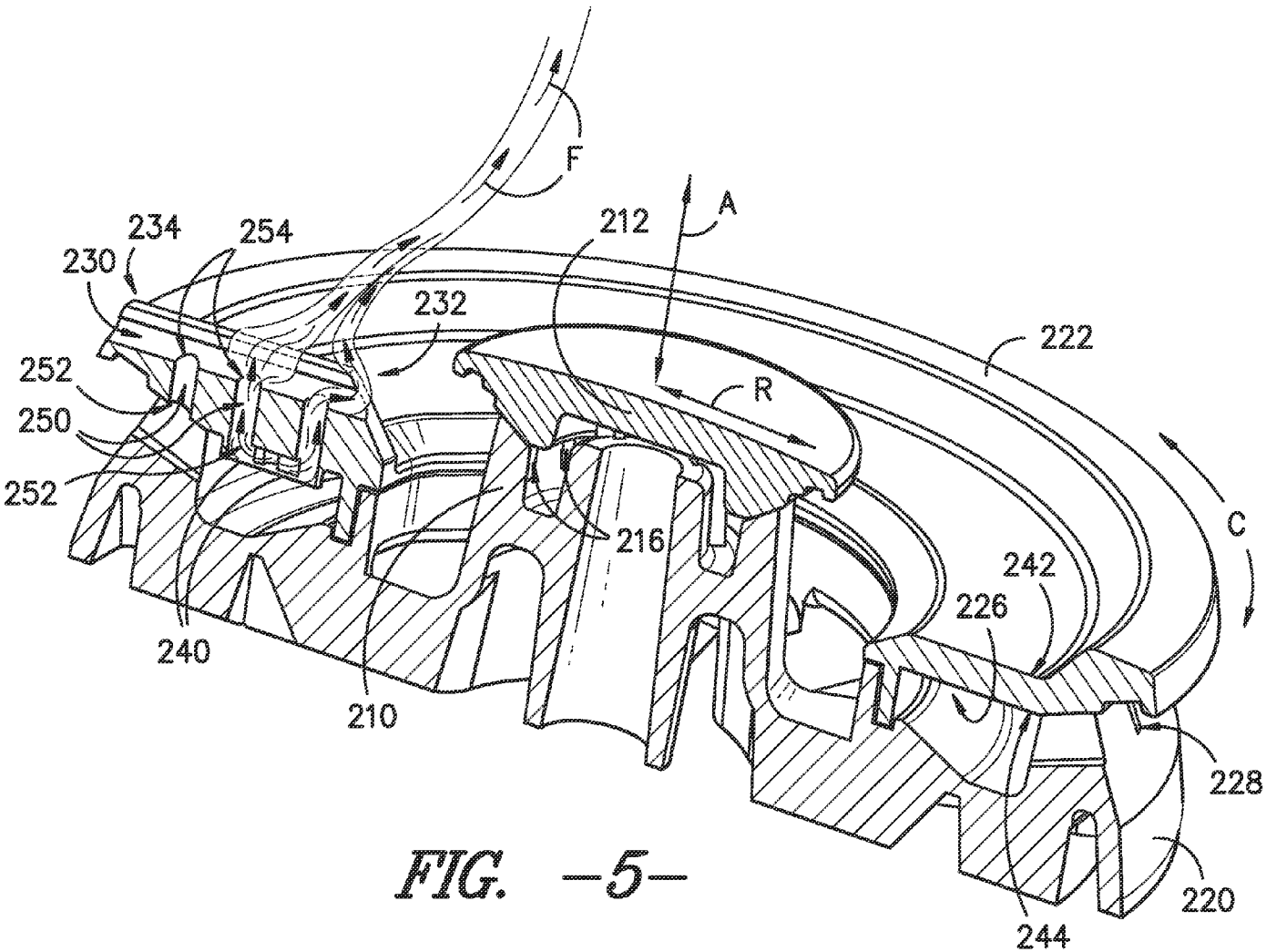
FIG. 5 provides a section view of the gas burner of FIG. 2.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a top panel 104. By way of example, top panel 104 may be constructed of glass, ceramics, enameled steel, and combinations thereof.

For cooktop appliance 100, a utensil holding food and/or cooking liquids (e.g., oil, water, etc.) may be placed onto grates 116 at a location of any of burner assemblies 106, 108, 109, and 110. Burner assemblies 106, 108, 109, and 110 provide thermal energy to cooking utensils on grates 116. As shown in FIG. 1, burners assemblies 106, 108, 109, and 110 can be configured in various sizes so as to provide e.g., for the receipt of cooking utensils (i.e., pots, pans, etc.) of various sizes and configurations and to provide different heat inputs for such cooking utensils. Grates 116 are supported on a top surface 118 of top panel 104.

A user interface panel 112 is located within convenient reach of a user of the cooktop appliance 100. For this exemplary embodiment, panel 112 includes knobs 114 that are each associated with one of burner assemblies 106, 108, 109, and 110. Knobs 114 allow the user to activate each burner assembly and determine the amount of heat input provided by each burner assembly 106, 108, 109, and 110 to a cooking utensil located thereon. Panel 112 may also be provided with one or more graphical display devices that deliver certain information to the user such as e.g., whether a particular burner assembly is activated and/or the level at which the burner assembly is set.

Although shown with knobs 114, it should be understood that knobs 114 and the configuration of cooktop appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

FIG. 2 provides a perspective view of a multi-ring gas burner 200 according to an exemplary embodiment of the present subject matter. Multi-ring gas burner 200 may be used in any suitable appliance, e.g., a cooktop appliance, such as cooktop appliance 100 as one of burner assemblies 106, 108, 109, and 110 (FIG. 1). Burner 200 defines an axial direction A, a radial direction R, and a circumferential direction C.

Burner 200 includes multiple burner rings. In particular, burner 200 includes an inner burner ring 210 centrally disposed relative to an outer burner ring 220 that concentrically surrounds inner burner ring 210. Although shown with a single outer burner ring in the exemplary embodiment shown in FIGS. 2 and 3, in alternative exemplary embodiments, burner 200 may include multiple outer burner rings that concentrically surround inner burner ring 210. By providing multiple burner rings (e.g., inner and outer burner rings 210 and 220), heating of cooking utensils can be improved. For example, multiple burner rings can apply heat more evenly or uniformly to such cooking utensils.

Inner burner ring 210 has a top 212 and defines a plurality of outlets or exits 216. Exits 216 are spaced apart from one another along the circumferential direction C. Inner burner ring 210 receives fuel from a fuel supply (not shown) and directs such fuel to exits 216. At exits 216 such fuel may be combusted, e.g., to heat cooking utensils and food items located therein.

Outer burner ring 220 is spaced apart from inner burner ring 210 along the radial direction R. Outer burner ring 220 includes cover 222 and defines at least two inlets 224, a fuel chamber 226, and a plurality of outlets 228. Inlets 224 are spaced apart from one another along the circumferential direction C. Further, inlets 224 are configured for receiving fuel from the fuel supply and air and directing such fuel/air mixture into fuel chamber 226. Outlets 228 are spaced apart from one another along the circumferential direction C and are configured for directing fuel out of fuel chamber 226. At outlets 228 such fuel may be combusted, e.g., to heat cooking utensils and food items located therein.

Outer burner ring 220 also includes a cover 222 that assists with defining fuel chamber 226 when mounted to or positioned on burner 200. Cover 222 defines a carryover slot 230. Carryover slot 230 of cover 222 extends along the radial direction R, e.g., between about inner burner ring 210 and about outer burner ring 220. In particular, carryover slot 230 extends between a first end portion 232 and a second end portion 234. First and second end portions 232 and 234 are spaced apart from each other, e.g., along the radial direction. In particular, first end portion 232 of carryover slot 230 is positioned proximate, adjacent, or at inner burner ring 210, e.g., exits 216 of inner burner ring 210. Conversely, second end portion 234 of carryover slot 230 is positioned proximate, adjacent, or at outer burner ring 220, e.g., outlets 228 of outer burner ring 220.

Carryover slot 230 is configured for carrying flames between inner burner ring 210 and outer burner ring 220. As an example, burner 200 can include an ignition device (not shown) for igniting gaseous fuel at exits 216 of inner burner ring 210. In turn, flames at inner burner ring 210 can ignite gaseous fuel within carryover slot 230, and flames at carryover slot 230 can ignite gaseous fuel exiting outlets 228 of outer burner ring 220. In such a manner, carryover slot 230 can transfer flames from inner burner ring 210 to outer burner ring 220 and vice versa.

It should be understood that carryover slot 230 can be constructed independently of cover 222 and/or outer burner ring 220. For example, carryover slot 230 can be defined by a separate component mounted to inner burner ring 210, outer burner ring 220, or both. Thus, the exemplary embodiment shown in FIG. 2 is not intended to limit the present subject matter in any aspect.

FIG. 3 provides a top perspective view of cover 222 of burner 200. FIG. 4 provides a bottom perspective view of cover 222 of burner 200. As may be seen in FIGS. 3 and 4, cover 222 includes a top surface 242 and a bottom surface 244 positioned opposite each other on cover 222. Thus, top and bottom surfaces 242 and 244 are spaced apart from each other, e.g., along the axial direction A.

A pair of restrictors 240 is mounted to cover 222. In particular, restrictors 240 are positioned at bottom surface 244 of cover 222. Conversely, carryover slot 230 is positioned at top surface 242 of cover 222. Restrictors 240 are spaced apart from each other, e.g., along the radial direction R. In particular, restrictors 240 define a Venturi throttle 246 therebetween. As discussed in greater detail below, Venturi throttle 246 of restrictors 240 is configured for regulating a flow of gaseous fuel to carryover slot 230.

FIG. 5 provides a section view of burner 200. FIG. 6 provides a partial elevation view of cover 222 of burner 200. Cover 222 defines a plurality of passages 250 for supplying gaseous fuel (shown with arrows F), e.g., from fuel chamber 226, to carryover slot 230. Passages 250 are spaced apart from one another, e.g., along the radial direction R. Multiple passages 250 along the radial direction R distribute fuel throughout carryover slot 230 and assist with transferring flames between inner and outer burner rings 210 and 220 as discussed above.

Each passage 250 has an inlet 252, e.g., at bottom surface 244 of cover 222, for receiving gaseous fuel F. Further, each passage 250 also has an outlet 254, e.g., positioned at top surface 242 of cover 222 within carryover slot 230. Thus, passages 250 can extend between top surface 242 of cover 222 and bottom surface 244 of cover 222, e.g., along the axial direction A.

Certain passages of passages 250 can supply gaseous fuel from Venturi throttle 246 of restrictors 240 to carryover slot 230. In particular, each restrictor 240 is positioned at a respective one of inlets 252 of passages 250. Venturi throttle 246 of restrictors 240 is configured for regulating a flow of gaseous fuel into such inlets 252 of passages 250 as discussed in greater detail below.

As shown in FIG. 6, each restrictor 240 has a throttling surface 260 that assists with defining Venturi throttle 246. Throttling surfaces 260 are spaced apart from each other, e.g., along the radial direction R. In particular, throttling surfaces 260 can be positioned such that throttling surfaces 260 face each other, e.g., along the radial direction R. Throttling surfaces 260 can be spaced apart from each other, e.g., along the radial direction R by a distance, D.

As may be seen in FIG. 6, the distance D can vary along the circumferential direction C. Due to such tapering, Venturi throttle 246 can receive gaseous fuel flowing through fuel chamber 226, and such fuel can increase in velocity and decease in pressure as such fuel passes through Venturi throttle 246. At the respective inlets 252 of passages 250, such throttled fuel can enter respective passages 250 and flow to carryover slot 230.

FIG. 7 provides a plot of flow rates into a carryover slot of a gas burner versus flow rates into the gas burner for various passage configurations. In particular, FIG. 7 provides plots of flow rates into a carryover slot of a gas burner with eight hundredths of an inch diameter passages versus flow rates into the gas burner, flow rates into a carryover slot of a gas burner with six hundredths of an inch diameter passages versus flow rates into the gas burner, and flow rates into carryover slot 230 with Venturi throttle 246 versus flow rates into burner 200.

As may be seen FIG. 7 by providing regulators 240 and Venturi throttle 246, fuel flow to carryover slot 230 can be improved. Venturi throttle 246 can assist with regulating fuel flow to carryover slot 230 at both high and low flow rates. In particular, Venturi throttle 246 can assist with restraining fuel flow into carryover slot 230 at high flow rates in burner 200, e.g., to limit flame height at carryover slot 230. Further, Venturi throttle 246 can assist with providing sufficient fuel flow into carryover slot 230 at low flow rates in burner 200, e.g., to permit carryover slot 230 to function properly. Thus, providing regulators 240 and Venturi throttle 246 can improve performance of burner 200 compared to adjusting diameter size of passages 250 in order to limit flame height at carryover slot 230 at high flow rates in burner 200 and permit carryover slot 230 to function properly at low flow rates in burner 200.

As may be seen in FIG. 5, in certain exemplary embodiments, at least one inlet of passages 250 does not have a restrictor 240 mounted thereat.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A multi-ring gas burner for a cooktop appliance, the multi-ring gas burner defining a radial direction, the multi-ring gas burner comprising:
   - an inner burner ring;
   - an outer burner ring spaced apart from said inner burner ring along the radial direction;
   - a carryover slot extending between about said inner burner ring and about said outer burner ring, said carryover slot comprising a plurality of passages dispersed along the radial direction between said inner and outer burner rings, each passage of the plurality of passages having an inlet for receiving gaseous fuel; and
   - means for increasing a velocity and decreasing a pressure of fuel at a pair of inlets of the plurality of passages.

2. The multi-ring gas burner of claim 1, wherein said carryover slot is configured for carrying flames between said inner and outer burner rings.

3. A multi-ring gas burner for a cooktop appliance; the multi-ring gas burner defining a radial direction and a circumferential direction, the multi-ring gas burner comprising:
   - an inner burner ring;
   - an outer burner ring spaced apart from said inner burner ring along the radial direction;
   - a carryover slot extending between said inner and outer burner rings, said carryover slot comprising a plurality of passages dispersed along the radial direction between said inner and outer burner rings, each passage of the plurality of passages having an inlet for receiving gaseous fuel; and
   - a pair of restrictors define a Venturi throttle therebetween, each restrictor of said pair of restrictors positioned at a respective one of the inlets of the plurality of passages, each restrictor of said pair of restrictors having a throttling surface, the throttling surfaces of said pair of restrictors spaced apart from each other along the radial direction by a distance, D, the distance D varying along the circumferential direction.

4. The multi-ring gas burner of claim 3, wherein at least one inlet of the plurality of passages does not have a restrictor mounted thereat.

5. The multi-ring gas burner of claim 3, wherein said outer burner ring has a top surface and a bottom surface positioned opposite each other on said outer burner ring, the carryover slot positioned at the top surface of said outer burner ring, said pair of restrictors positioned at the bottom surface of said outer burner ring.

6. The multi-ring gas burner of claim 5, wherein the passages of the plurality of passages extend between the top and bottom surfaces of said outer burner ring in order to supply gaseous fuel from the Venturi throttle of said pair of restrictors to said carryover slot.

7. The multi-ring gas burner of claim 3, wherein the restrictors of said pair of restrictors are spaced apart from each other along the radial direction.

8. The multi-ring gas burner of claim 3, wherein said carryover slot is configured for carrying flames between said inner burner ring and said outer burner ring, wherein the Venturi throttle of said pair of restrictors is configured for regulating a flow of gaseous fuel to said carryover slot.

9. A multi-ring gas burner for a cooktop appliance, the multi-ring gas burner defining a radial direction, the multi-ring gas burner comprising:

an inner burner ring defining a plurality of outlets for directing gaseous fuel out of said inner burner ring;

an outer burner ring spaced apart from said inner burner ring along the radial direction, said outer burner ring defining a plurality of outlets for directing gaseous fuel out of said outer burner ring, said outer burner ring having a cover that defines a carryover slot and a plurality of passages for supplying gaseous fuel to the carryover slot, the carryover slot of the cover extending between about said inner burner ring and about said outer burner ring, each passage of the plurality of passages having an inlet for receiving gaseous fuel; and a pair of restrictors mounted to the cover of said outer burner ring, each restrictor of said pair of restrictors positioned at a respective one of the inlets of the plurality of passages, said pair of restrictors defining a Venturi throttle therebetween, wherein at least one inlet of the plurality of passages does not have a restrictor mounted thereat.

10. The multi-ring gas burner of claim 9, wherein the passages of the plurality of passages are spaced apart from one another along the radial direction.

11. The multi-ring gas burner of claim 9, wherein the cover of said outer burner ring has a top surface and a bottom surface positioned opposite each other on the cover of said outer burner ring, the carryover slot positioned at the top surface of the cover, said pair of restrictors positioned at the bottom surface of the cover.

12. The multi-ring gas burner of claim 11, wherein the passages of the plurality of passages extend between the top surface of the cover and the bottom surface in order to supply gaseous fuel from the Venturi throttle of said pair of restrictors to the carryover slot of said outer burner ring.

13. The multi-ring gas burner of claim 9, wherein the restrictors of said pair of restrictors are spaced apart from each other along the radial direction.

14. The multi-ring gas burner of claim 9, wherein each passage of the plurality of passages has an outlet positioned within the carryover slot of said outer burner ring.

15. The multi-ring gas burner of claim 9, wherein the carryover slot of said outer burner ring is configured for carrying flames between said inner burner ring and said outer burner ring, wherein the Venturi throttle of said pair of restrictors is configured for regulating a flow of gaseous fuel into the respective inlets of the plurality of passages.

16. The multi-ring gas burner of claim 9, wherein the multi-ring gas burner defines a circumferential direction, each restrictor of said pair of restrictors having a throttling surface, the throttling surfaces of said pair of restrictors spaced apart from each other along the radial direction by a distance, D, the distance D varying along the circumferential direction.

* * * * *